US006828999B2

(12) United States Patent
Murao

(10) Patent No.: US 6,828,999 B2
(45) Date of Patent: Dec. 7, 2004

(54) LIGHT EMITTING DEVICE, LIGHT EMITTING DEVICE ARRAY, AND PRINTER HAVING LIGHT EMITTING DEVICE ARRAY

(75) Inventor: Yugo Murao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/216,287

(22) Filed: Aug. 12, 2002

(65) Prior Publication Data

US 2003/0030717 A1 Feb. 13, 2003

(30) Foreign Application Priority Data

Aug. 10, 2001 (JP) ..... 2001-244376

(51) Int. Cl.[7] ..... B41J 2/45; B41J 27/00
(52) U.S. Cl. ..... 347/238; 347/244; 347/258
(58) Field of Search ..... 347/238, 241, 347/244, 256, 258, 130, 134; 428/209

(56) References Cited

U.S. PATENT DOCUMENTS 5,855,994 A * 1/1999 Biebuyck et al. ..... 428/209
6,661,445 B2 * 12/2003 Mashimo et al. ..... 347/238

FOREIGN PATENT DOCUMENTS

| | | | | |
|---|---|---|---|---|
| JP | 09-226171 | | 9/1997 | |
| JP | 10-172756 | * | 6/1998 | ..... H05B/33/02 |
| JP | 2001-071558 | | 3/2001 | |
| JP | 2001135477 A | * | 5/2001 | ..... H05B/33/02 |

* cited by examiner

*Primary Examiner*—Hai Pham

(57) ABSTRACT

A light emitting device includes a lens member having a light inputting surface and a light outputting surface for converging light incident on the light inputting surface and outputting the converged light from the light outputting surface, and an organic EL device provided on the light inputting surface of the lens member.

15 Claims, 4 Drawing Sheets

LIGHT EMITTING DEVICE, LIGHT EMITTING DEVICE ARRAY, AND PRINTER HAVING LIGHT EMITTING DEVICE ARRAY

CROSS-REFERENCE TO RELATED APPLICATION

This application is related to Japanese Patent Application No. 2001-244376 filed in Aug. 10, 2001, whose priority is claimed under 35 USC §119, the disclosure of which is incorporated by reference in its entirety.

BACKGROUND OF THE INVENTION

1. Field of the Invention

The present invention relates to a light emitting device and, particularly, to a light emitting device for a printer head.

2. Description of the Related Art

In recent years, display devices employing organic thin film electroluminescent devices have actively been developed by research institutes and corporations, and some of the display devices have already been put into practical use by some makers. The research and development are now directed not only to flat displays including display devices provided on a flat glass substrate but also to flexible displays including organic thin film electroluminescent devices provided on a plastic film and adapted to be installed on a curved surface of a pillar or to be rolled for transportation thereof.

On the other hand, laser beam printers employing a laser light source and LED printers employing an LED light source have been put into practical use.

Printer heads and printers employing organic electroluminescent devices as a light source are also under research and development, which are promising as less costly heads and energy-saving printers (see, for example Japanese Unexamined Patent Publications Nos. Hei 9(1997)-226171 and 2001-071558).

In the laser beam printer, a laser beam is turned on and off according to an image pattern, while being scanned over a photoreceptor by means of a polygon mirror. Therefore, a correspondingly greater space is required for optically scanning the laser beam from one end to the other end of the photoreceptor, making it difficult to reduce the size of the laser beam printer. Where a greater-size optical system is required for scanning a laser beam over a greater-size photoreceptor, the laser beam is incident on an edge portion of the photoreceptor at a greater angle, so that the laser beam is liable to be distorted.

The LED printer is easier in size reduction than the laser beam printer. However, LED chips of the LED printer suffer from variations in brightness, requiring measures against brightness unevenness, for example, screening of the LED chips and brightness adjustment by a driving circuit. This leads to an increase in costs.

On the contrary, the organic electroluminescent devices can collectively be formed on a film and, therefore, are advantageous for suppression of brightness variations, size reduction of the optical system and cost reduction when used for a printer head.

However, the printer head constituted by the organic electroluminescent devices has a lower light intensity per unit area, requiring application of a more intensive electric field for a higher electric current density than the display device to output light sufficient for exposure of the photoreceptor drum.

If the electric current density is increased, the organic electroluminescent devices tend to have a lower light emitting efficiency and a shorter service life. In order to reduce the light emitting intensity per unit area and, at the same time, to provide a sufficient light intensity on the photoreceptor, the area of each of the organic electroluminescent devices should be increased, and light beams emitted from the larger-area organic electroluminescent devices should be converged on the photoreceptor.

SUMMARY OF THE INVENTION

In view of the foregoing, the present invention is directed to a light emitting device which employs an organic electroluminescent device having a greater area and is adapted to converge a light beam emitted from the organic electroluminescent device into a sufficiently small light spot to provide a light intensity sufficient for exposure of a photoreceptor drum, and to a light emitting device array including a plurality of such light emitting devices.

In accordance with the present invention, there is provided a light emitting device, which comprises a lens member having a light inputting surface and a light outputting surface for converging light incident on the light inputting surface and outputting the converged light from the light outputting surface, and an organic EL device provided on the light inputting surface of the lens member.

DESCRIPTION OF THE PREFERRED EMBODIMENTS

Figure 1:
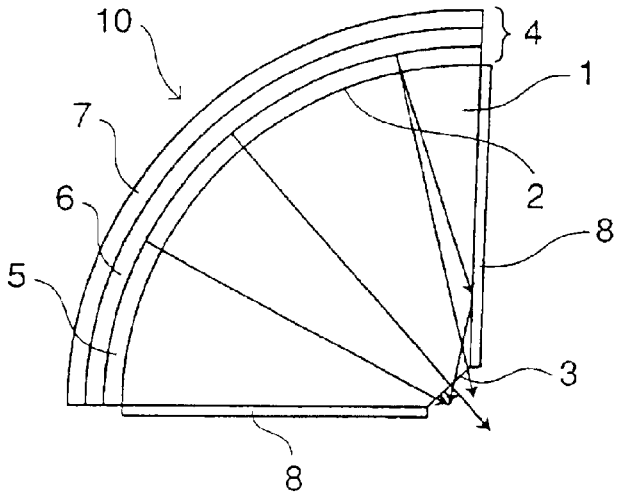
FIG. 1 is a side view illustrating a light emitting device according to one embodiment of the present invention.

A light emitting device according to the present invention comprises a lens member having a light inputting surface and a light outputting surface for converging light incident on the light inputting surface and outputting the converged light from the light outputting surface, and an organic EL device provided on the light inputting surface of the lens member.

Exemplary materials for the lens member include highly transparent methacryl resins, polystyrene resins and polycarbonate resins.

The lens member has a fan-shaped cross section, for example. The light inputting surface is located on a curved peripheral portion of the lens member, and the light outputting surface is located on a ridge portion of the lens member, the ridge portion being opposite to the curved peripheral portion. In this case, the light outputting surface is preferably shaped as a convex lens. This improves the convergence of the light outputted from the light outputting surface.

The organic EL device may comprise a transparent first electrode layer provided on the light inputting surface of the lens member, an organic film provided on the first electrode layer, and a second electrode layer provided on the organic film.

In this case, the organic film comprises, for example, a hole transporting layer, a light emitting layer and an electron transporting layer stacked in this order. The light emitting layer may be doped with a light emitting dye.

The light emitting layer is composed of a low molecular light emitting material or a polymer light emitting material. Examples of the low molecular light emitting material include 8-hydroxyquinolinol derivatives, thiazole derivatives, benzoxazole derivatives, quinacridone derivatives, styrylarylene derivatives, perylene derivatives, oxazole derivatives, oxadiazole derivatives, triazole derivatives, triphenylamine derivatives and fluorescent metal complexes.

Examples of the polymer light emitting material include poly-p-phenylene vinylene (PPV) derivatives, polyvinyl carbazole (PVK), polyfluorene derivatives and polythiophene derivatives.

Exemplary materials for the hole transporting layer include conductive polymers such as triphenylamine derivatives, PPV derivatives and polyaniline, and P-type semiconductor materials.

Exemplary materials for the electron transporting layer include oxadiazole derivatives, metal complexes and PPV derivatives.

Exemplary materials for the transparent first electrode include inorganic thin films such as of indium-tin oxide (ITO), $SnO_2$ and Au, polyaniline thin films, and polythiophene thin films.

Exemplary materials for the second electrode include silver, magnesium, aluminum, indium, lithium, calcium and gold.

Light emitting devices each having the aforesaid construction according to the present invention are arranged in line to constitute a light emitting device array which can be used for printers of various image forming apparatus such as a copier and a facsimile machine. In this case, the lens members of the light emitting devices should each have a plate shape having a thickness corresponding to a pixel density.

Therefore, the lens members preferably each comprise a fan-shaped light transmissive plate. The light inputting surface is located on a curved peripheral surface of the fan-shaped light transmissive plate, and the light outputting surface is located on a ridge portion of the fan-shaped light transmissive plate, the ridge portion being opposite to the curved peripheral surface.

The fan-shaped light transmissive plate preferably includes at least one of a light shielding film and a reflective film provided on at least one of front and back surfaces thereof.

The fan-shaped light transmissive plate preferably further includes reflective films respectively provided on flat peripheral surfaces thereof, whereby the light is prevented from leaking to the outside from the flat peripheral surfaces.

The light emitting device array according to the present invention comprises a light transmissive block having a fan-shaped cross section and including a plurality of fan-shaped light transmissive plates, and an organic EL device provided on a curved peripheral surface of the light transmissive block. The organic EL device includes a plurality of light emitting sections arranged in line at pitches corresponding to the respective fan-shaped light transmissive plates. Light beams emitted from the respective light emitting sections are incident on curved peripheral surfaces of the corresponding fan-shaped light transmissive plates, and outputted from ridge portions of the corresponding fan-shaped light transmissive plates, the ridge portions being opposite to the curved peripheral surfaces.

The light transmissive block preferably includes at least one of a light shielding film and a reflective film respectively provided on mating surfaces of each adjacent pair of fan-shaped light transmissive plates, whereby crosstalk of light between adjacent light emitting sections is prevented.

The light transmissive block preferably includes reflective films respectively provided on flat peripheral surfaces thereof, whereby the light is prevented from leaking to the outside.

The ridge portions of the fan-shaped light transmissive plates are preferably each shaped as a convex lens. Alternatively, the fan-shaped light transmissive block may have a convex lens film provided on the ridge portion thereof. Thus, the light beams emitted from the respective light emitting sections are efficiently converged.

The organic EL device of the light emitting device array may comprise a transparent first electrode provided on the curved peripheral surface of the light transmissive block, an organic film provided on the first electrode, and a second electrode provided on the organic film, wherein at least one of the first and second electrodes is divided at pitches corresponding to the respective fan-shaped light transmissive plates. The organic EL device may preliminarily be formed on a flexible transparent film, which is in turn bonded onto the curved peripheral surface of the light transmissive block.

With reference to the attached drawings, the present invention will hereinafter be described in detail by way of embodiments thereof. It should be understood that the invention be not limited to these embodiments.

FIG. 1 is a side view illustrating a light emitting device according to one embodiment of the present invention. As shown, the light emitting device 10 includes a lens member 1 having a fan-shaped cross section. The fan-shaped lens member 1 has a light inputting surface 2 located on a curved peripheral portion thereof, and a light outputting surface 3 located on a ridge portion thereof. The curved peripheral portion is opposite to the ridge portion. A flat organic EL device 4 is laminated on the light inputting surface 2.

The organic EL device 4 includes a transparent anode electrode 5 provided on the light inputting surface 2, an organic film 6 provided on the anode electrode 5, and a cathode electrode 7 provided on the organic film 6.

In the light emitting device 10, light emitted from the organic EL device 4 is converged through the lens member 1 on the light outputting surface 3, and outputted from the light outputting surface 3.

Aluminum reflective films 8 are bonded onto flat peripheral surfaces of the fan-shaped lens member 1 to prevent the light from leaking from the peripheral surfaces of the light emitting device 10.

Figure 2:
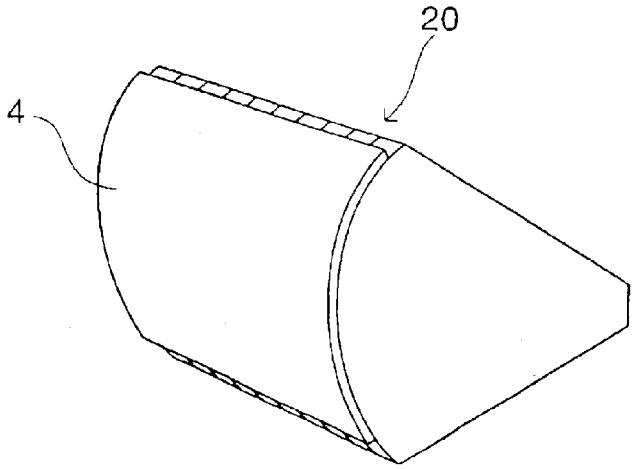
FIG. 2 is a rear perspective view of a light emitting device array according to another embodiment of the present invention.
Figure 3:
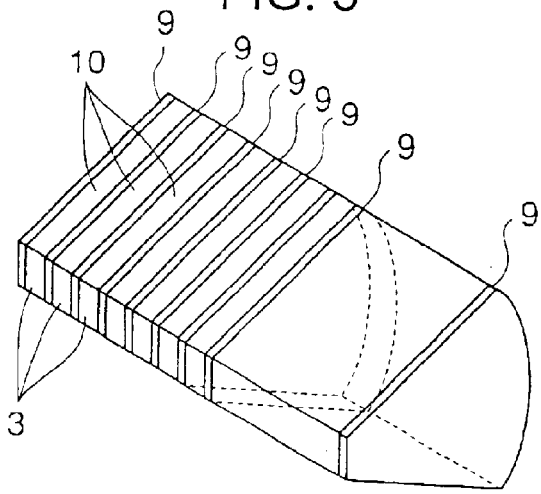
FIG. 3 is a front perspective view of the inventive light emitting device array.

FIGS. 2 and 3 are a rear perspective view and a front perspective view, respectively, of a light emitting device array 20 including a plurality of light emitting devices 10 arranged in line. As shown, the plurality of light emitting devices 10 are arranged in line in the light emitting device array 20, and bonded to each other with the intervention of light shielding reflective films 9 of aluminum. The light shielding reflective films 9 permit the respective light emitting devices 10 to output light beams from the light outputting surfaces 3 without any crosstalk between the light emitting devices 10.

Where the light emitting device array 20 is applied to a printer head having a pixel density of 400 dpi, a pixel pitch is 63.5 μm. Therefore, the light emitting devices 10 shown in FIG. 3 are arranged at this pixel pitch.

More specifically, lens members 1 of the light emitting devices 10 each have a thin plate shape having a thickness of about 40 μm, and the total thickness of the lens member 1 and the light shielding reflective film 9 is equalized with the aforesaid pitch (63.5 μm). Where the light emitting device array 20 is used as a printer head for JIS A4-size sheets (width: 23.6 cm), for example, the light emitting device array 20 includes 3717 light emitting devices 10 stacked as shown in FIG. 3.

Next, an explanation will be given to a method for producing the light emitting device array 20.

Figure 4:
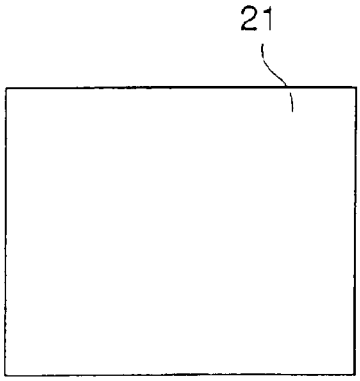
FIGS. 4(*a*) to 4(*e*) are process diagrams illustrating a production method for the inventive light emitting device array.
Figure 4:
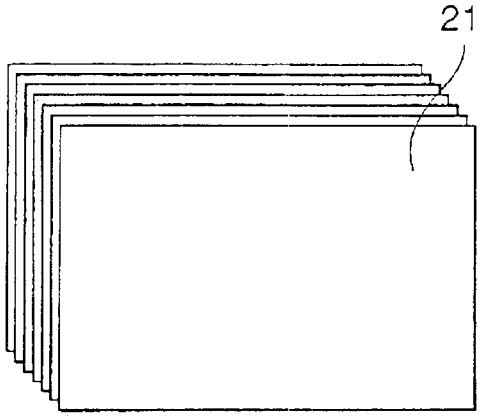
Figure 4:
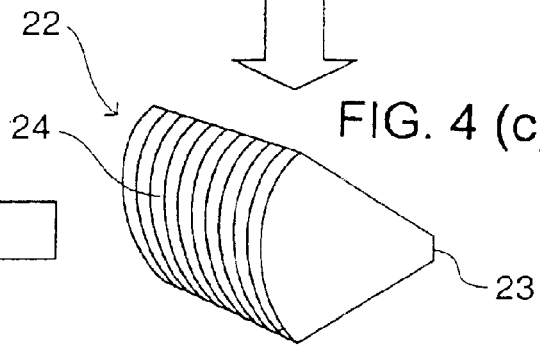
Figure 4:
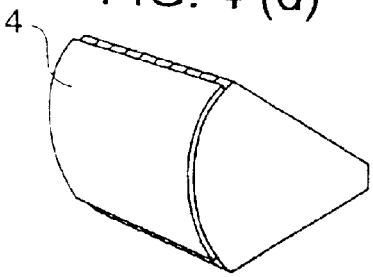
Figure 4:
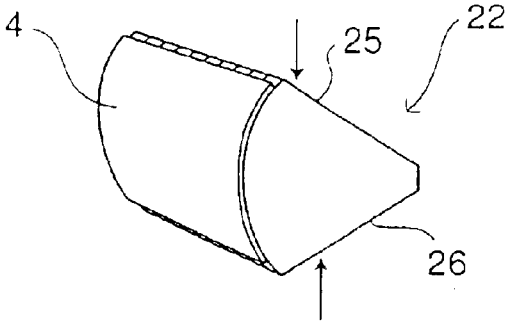

As shown in FIG. 4(*a*), a light shielding reflective film is formed on both or one of opposite surfaces of an optically transparent sheet 21, and an adhesive layer is formed on the light shielding reflective film. A required number of such sheets 21 are prepared in this manner.

As shown in FIG. 4(*b*), the sheets 21 are laminated together. For production of a 400-dpi printer head for JIS A4 size in longitudinal orientation, the sheets 21 each have a thickness of about 40 μm, and the total thickness of the sheet and the light shielding reflective film is adjusted to be equal to 63.5 μm after completion of the light emitting device array. In this case, the number of the sheets 21 to be laminated is 3717.

After the sheets 21 are laminated together, the resulting laminate is cut for formation of a light transmissive block 22 having a fan-shaped cross section as shown in FIG. 4(*c*). Then, surfaces of the light transmissive block are each polished to a sufficient optical accuracy. A cylindrical convex lens or a convex lens film may be attached to an end face 23 of a ridge portion of the fan-shaped light transmissive block 22 for suppression of scattering of light beams from the light outputting surfaces and for convergence of the light beams.

An organic EL device 4 is formed on a curved peripheral surface 24 of the light transmissive block 22. The surface 24 is opposite to the end face 23. The formation of the organic EL device 4 may be achieved in substantially the same manner as in the conventional process, except that a curved patterning mask conformal to the curved peripheral surface of the light transmissive block 22 is required.

An $SiO_2$ film is formed on the curved peripheral surface 24 to prevent an organic film from being affected by moisture. Then, anode electrodes (driving electrodes) are formed of ITO on the $SiO_2$ film. The anode electrodes each have a width of about 40 μm, and arranged at a pitch of 63.5 μm in a stripe pattern. Light emitting sections corresponding to the respective anode electrodes are formed in positions such that light beams emitted from the respective light emitting sections can efficiently be inputted into the corresponding sheets 21.

In turn, the organic film is formed over the anode electrodes by evaporation or the like, and a common cathode electrode is formed of a metal such as Al on the organic film. Finally, a $SiO_2$ film is formed on the cathode electrode for prevention of an influence of moisture. An anode electrode may be formed as a common electrode, and cathode electrodes may be formed in a stripe pattern as driving electrodes.

After the formation of the organic EL device 4, reflective films of a metal such as aluminum are formed on two side faces 25, 26 of the light transmissive block 22, as shown in FIG. 4(*e*), for prevention of leak of the light beams from the light transmissive block 22.

A modification of the production method will next be described. More specifically, the organic EL device 4 is preliminarily formed on a flexible transparent film which can be bonded onto the curved peripheral surface 24, and the film formed with the organic EL device is bonded onto the curved peripheral surface 24.

The light transmissive block 22 is produced in the same manner as shown in FIGS. 4(*a*) to 4(*c*). Before the film formed with the organic EL device is bonded onto the curved peripheral surface 24, the reflective films are formed on the side surfaces 25, 26 as shown in FIG. 4(*e*) by coating.

Figure 5:
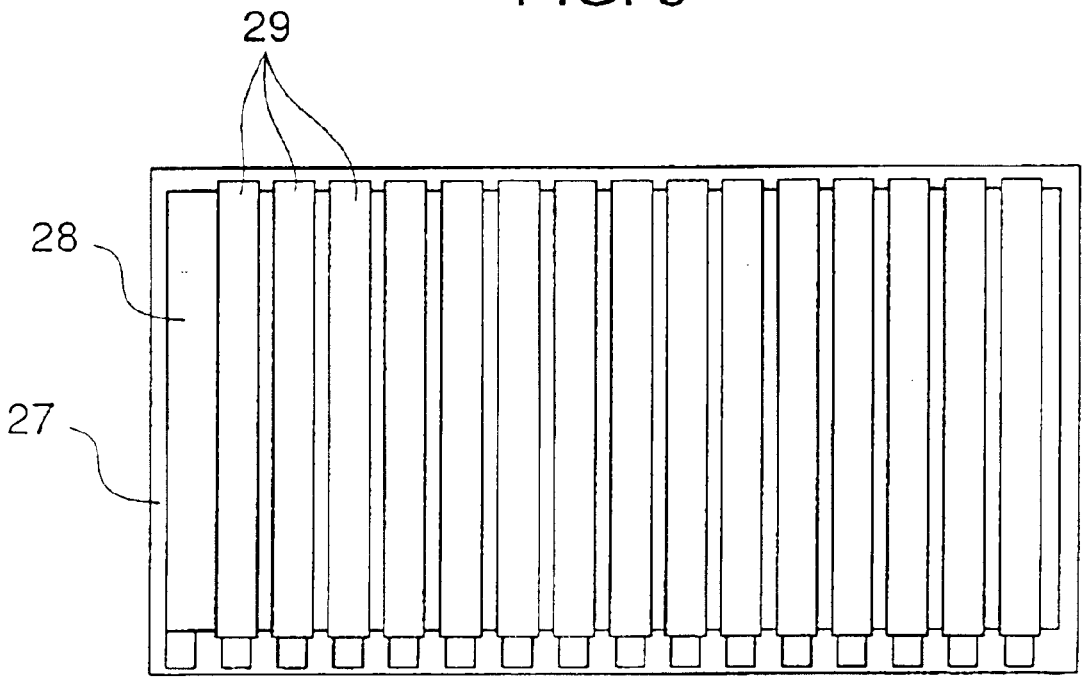
FIG. 5 is a rear view illustrating a modification of the inventive light emitting device array.

The on-film organic EL device includes electrodes arranged in a stripe pattern having the same pitch as the laminated sheets 21. FIG. 5 illustrates an exemplary on-film organic EL device which is produced by forming an anode electrode (common electrode) 28 on a flexible transparent film 27, forming an organic film on the anode electrode, and forming cathode electrodes 29 arranged in a stripe pattern.

The film formed with the organic EL device is bonded onto the curved peripheral surface 24 so that light beams emitted through the striped cathode electrodes 29 can respectively be incident on the laminated sheets 21.

For positioning of the film 27 formed with the organic EL device, every second light emitting section of the organic EL device on the film 27 is actuated, and the position of the organic EL device is adjusted so that the intensity of a light beam outputted through every second light outputting surface is maximized. For correction of circumferential offsets of the striped cathode electrodes 29 of the organic EL device on the film 27 with respect to the curved peripheral surface 24, the positions of the cathode electrodes 29 are adjusted so that the ratio of the intensities of light beams outputted through each adjacent pair of light outputting surfaces is maximized.

Figure 6:
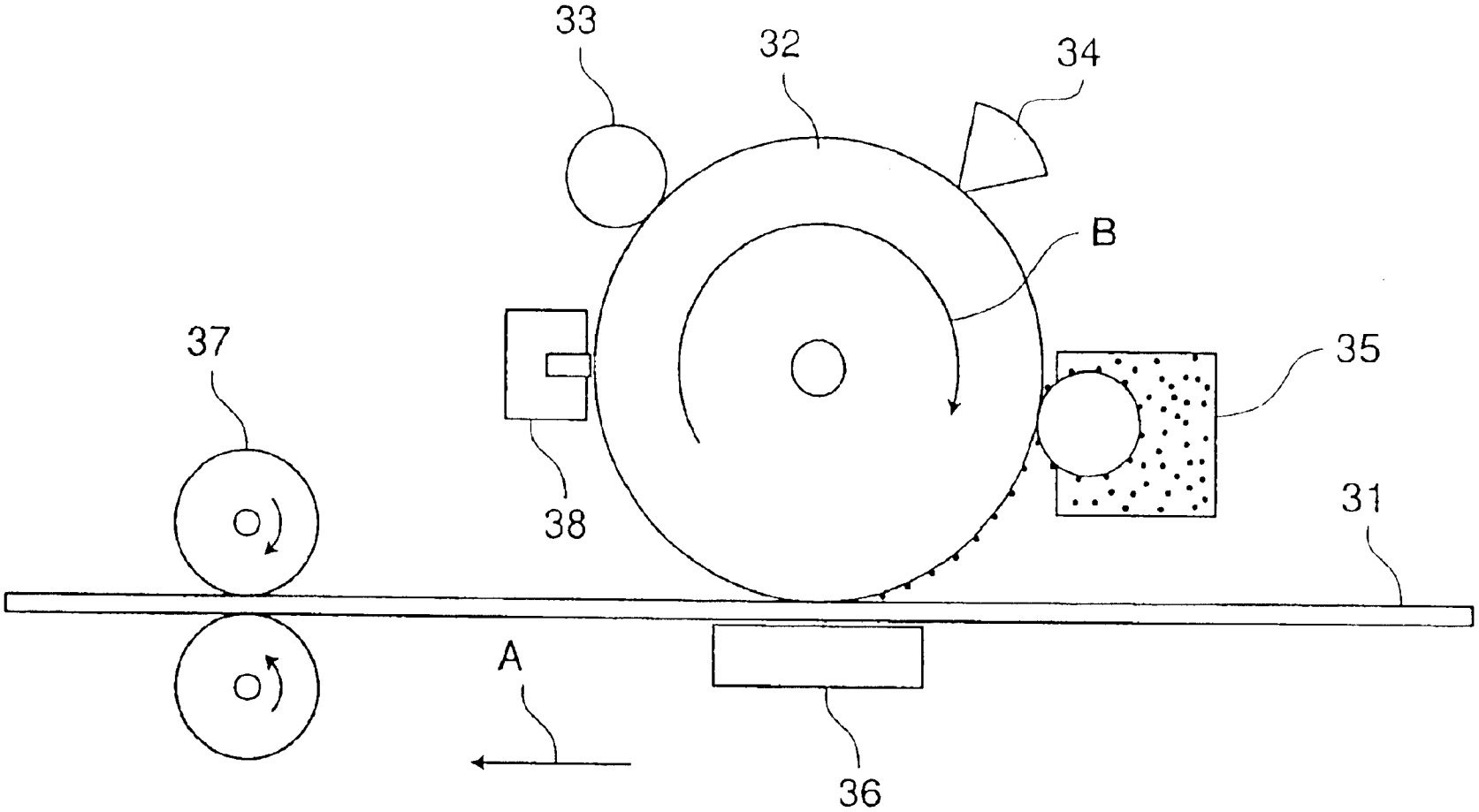
FIG. 6 is an explanatory diagram illustrating the construction of a printer which employs the inventive light emitting device array as a printer head.

FIG. 6 is a diagram illustrating the construction of a printer employing the inventive light emitting device array as a printer head. A paper sheet to be printed is transported in an arrow direction A, and a photoreceptor drum 32 is rotated in an arrow direction B.

The surface of the photoreceptor drum 32 initially has positively charged portions and negatively charged portions. The entire surface of the photoreceptor drum 32 is brought into contact with an energized charging roller 33 thereby to be electrically negatively charged.

An image (letters and the like) is written on the photoreceptor drum by a printer head 34 including the light emitting device of the invention. That is, the organic EL device array of the light emitting device emits light beams according to print data. Portions of the photoreceptor drum exposed to the light beams are positively charged, while the other portion of the photoreceptor drum is kept negatively charged.

In a developer unit 35, negatively charged toner is applied onto the surface of the photoreceptor drum 32. At this time, the toner adheres only onto the positively charged portions of the photoreceptor drum 32.

A transfer unit 36 is more heavily positively charged than the photoreceptor drum 32, so that the negatively charged toner is attracted by the transfer unit 36 thereby to be transferred from the photoreceptor drum 32 onto the paper sheet 31. The paper sheet 31 is transported through a fixing unit 37, whereby the toner is fixed onto the paper sheet 31 by pressure and heat applied by a pair of rollers. Thus, the image is printed out on the paper sheet 31. Residual toner on the photoreceptor drum 32 is removed by a cleaner 38. Then, the photoreceptor drum 32 is charged again by the charging roller 33. Thus, the printing operation on the paper sheet 31 is completed.

According to the present invention, a small-size and light-weight organic EL device is employed to realize a printer head which is capable of outputting light with smaller pixel-to-pixel variations.

What is claimed is:

1. A light emitting device comprising:

a lens member having an arcuate-shaped light inputting surface and a light outputting surface for converging light incident on the arcuate-shaped light inputting surface and outputting the converged light from the light outputting surface;

an organic EL device provided directly on so as to contact the arcuate-shaped light inputting surface of the lens member; and wherein the lens member comprises a fan-shaped light transmissive plate, the light inputting surface being located on a curved peripheral surface of the fan-shaped light transmissive plate, the light outputting surface being located on a ridge portion of the fan-shaped light transmissive plate, the curved peripheral surface being opposite to the ridge portion.

2. A light emitting device as set forth in claim 1, wherein the light outputting surface is shaped as a convex lens.

3. A light emitting device as set forth in claim 1, wherein the organic EL device comprises a transparent first electrode layer provided on the light inputting surface of the lens member, an organic film provided on the first electrode layer, and a second electrode layer provided on the organic film.

4. A light emitting device as set forth in claim 1, wherein the organic EL device is an organic EL device provided on a flexible film.

5. A light emitting device as set forth in claim 1, wherein the fan-shaped light transmissive plate comprises at least one of a light shielding film and a reflective film provided on at least one of front and back surfaces thereof.

6. A light emitting device as is set forth in claim 1, wherein the fan-shaped light transmissive plate further comprises reflective films respectively provided on flat peripheral surfaces thereof.

7. A light emitting device array comprising a plurality of light emitting devices each recited in claim 1, the light emitting devices being arranged in line.

8. A light emitting device comprising:

a lens member having a light inputting surface and a light outputting surface for converging light incident on the light inputting surface and outputting the converged light from the light outputting surface;

an organic EL device provided on the light inputting surface of the lens member; and wherein the lens member has a fan-shaped cross section, the light inputting surface being located on a curved peripheral portion of the lens member, the light outputting surface being located on a ridge portion of the lens member, the ridge portion being opposite to the curved peripheral portion.

9. A light emitting device array comprising:

a light transmissive block having a fan-shaped cross section and comprising a plurality of fan-shaped light transmissive plates stacked on one another; and an organic EL device provided on a curved peripheral surface of the light transmissive block, wherein the organic EL device comprises a plurality of light emitting sections arranged in line at pitches corresponding to the respective fan-shaped light transmissive plates, light beams emitted from the respective light emitting sections being incident on curved peripheral surfaces of the corresponding fan-shaped light transmissive plates and outputted from ridge portions of the corresponding fan-shaped light transmissive plates, the ridge portions being opposite to the curved peripheral surfaces.

10. A light emitting device array as set forth in claim 9, wherein the light transmissive block comprises at least one of a light shielding film and a reflective film respectively provided on mating surfaces of each adjacent pair of fan-shaped light transmissive plates.

11. A light emitting device array as set forth in claim 9, wherein the light transmissive block comprises reflective films respectively provided on flat peripheral surfaces thereof.

12. A light emitting device array as set forth in claim 9, wherein the ridge portions of the fan-shaped light transmissive plates are each shaped as a convex lens.

13. A light emitting device array as set forth in claim 9, wherein the fan-shaped light transmissive block comprises a convex lens film provided on the ridge portion thereof.

14. A light emitting device array as set forth in claim 9, wherein the organic EL device comprises a transparent first electrode provided on the curved peripheral surface of the light transmissive block, an organic film provided on the first electrode, and a second electrode provided on the organic film, at least one of the first and second electrodes being divided at pitches corresponding to the respective fan-shaped light transmissive plates.

15. A printer comprising a light emitting device array as recited in claim 9, the light emitting device array being incorporated as a printer head for exposure of a photoreceptor.

* * * * *